US012583706B2

(12) United States Patent
Hartgers et al.

(10) Patent No.: US 12,583,706 B2
(45) Date of Patent: Mar. 24, 2026

(54) SYSTEM AND METHOD FOR APPLYING ADHESIVE TAPE LINE

(71) Applicant: 3M INNOVATIVE PROPERTIES COMPANY, St. Paul, MN (US)

(72) Inventors: Andrew J. Hartgers, Ilderton (CA); Utsav Dogra, St. Thomas (CA)

(73) Assignee: 3M Innovative Properties Copmany, St. Paul, MN (US)

( * ) Notice: Subject to any disclaimer, the term of this patent is extended or adjusted under 35 U.S.C. 154(b) by 189 days.

(21) Appl. No.: 18/028,742

(22) PCT Filed: Oct. 1, 2021

(86) PCT No.: PCT/IB2021/059061
§ 371 (c)(1),
(2) Date: Mar. 27, 2023

(87) PCT Pub. No.: WO2022/070164
PCT Pub. Date: Apr. 7, 2022

(65) Prior Publication Data

US 2023/0331505 A1 Oct. 19, 2023

Related U.S. Application Data

(60) Provisional application No. 63/086,369, filed on Oct. 1, 2020.

(51) Int. Cl.
*B65H 35/00* (2006.01)

(52) U.S. Cl.
CPC ... *B65H 35/0013* (2013.01); *B65H 2404/742* (2013.01); *B65H 2701/377* (2013.01); *B65H 2801/51* (2013.01)

(58) Field of Classification Search
CPC ..... B65H 35/0013; B65H 2404/742; B65H 2701/377; B65H 2801/51
See application file for complete search history.

(56) References Cited

U.S. PATENT DOCUMENTS 6,796,351 B1 9/2004 Maeda
2016/0122150 A1 5/2016 Jiang
(Continued)

FOREIGN PATENT DOCUMENTS

CN 201511390 U 6/2010
CN 210029486 U 2/2020
(Continued)

OTHER PUBLICATIONS

Machine translation of CN 210029486 (Year: 2020).*
(Continued)

*Primary Examiner* — Vishal I Patel
(74) *Attorney, Agent, or Firm* — Kathleen B. Gross

(57) ABSTRACT

A system for applying an adhesive tape line to a work surface includes a tape guiding assembly for removably coupling with the work surface. The tape guiding assembly includes at least one fastening member for removably coupling the tape guiding assembly to the work surface. The tape guiding assembly also includes a guiding board coupled with the at least one fastening member, wherein the guiding board includes a board sliding surface. The system also includes an adhesive tape dispenser having a dispenser sliding surface, the adhesive tape dispenser positionable on the board sliding surface and supported by the dispenser sliding surface for slidable translation on the board sliding surface when applying the adhesive tape line to the work surface.

18 Claims, 7 Drawing Sheets

(56) References Cited

U.S. PATENT DOCUMENTS

| | | | | |
|---|---|---|---|---|
| 2016/0304144 | A1* | 10/2016 | MacArthur | B62D 65/06 |
| 2019/0112144 | A1* | 4/2019 | Naber | B65H 35/0033 |
| 2023/0365372 | A1 | 11/2023 | Hartgers et al. | |

FOREIGN PATENT DOCUMENTS

| | | | | |
|---|---|---|---|---|
| CN | 210162887 | U | 3/2020 | |
| CN | 111216969 | A | 6/2020 | |
| EP | 1497212 | B1 | 6/2007 | |
| JP | 4098904 | A | 3/1992 | |
| JP | H08259087 | A | 10/1996 | |
| JP | 2000351245 | A | 12/2000 | |
| JP | 2007253825 | A | 10/2007 | |
| KR | 20080002708 | U | 7/2008 | |
| KR | 101262285 | B1 | 5/2013 | |
| WO | WO-2020087048 | A2 * | 4/2020 | B29C 64/118 |

OTHER PUBLICATIONS

Machine translation of JP08259087A (Year: 1996).*
International Search Report for PCT International Application No. PCT/IB2021/058855, mailed on Dec. 24, 2021, 3 pages.
International Search Report for PCT International Application No. PCT/IB2021/059061, mailed on Dec. 27, 2021, 3 pages.

* cited by examiner

SYSTEM AND METHOD FOR APPLYING ADHESIVE TAPE LINE

BACKGROUND

Generally, an adhesive tape needs to be applied to various work surfaces. In some automotive applications, the adhesive tape may be applied to a work surface where a two-tone paint scheme for the car or truck is desired. For example, the adhesive tape may be applied to a car body panel during manufacturing on an assembly line. Application of the adhesive tape requires high accuracy, speed, and repeatability to meet modern automotive manufacturing requirements.

SUMMARY

On certain two-tone paint schemes, it becomes challenging to apply the adhesive tapes in an absence of a guiding edge or feature to create a datum for the tape applicators to ride along while applying the adhesive tape. For example, FIG. 5 shows such a location where the two-tone paint line is located at a position intersecting with the door openings and window on the side of the car's unibody frame. There is not an "edge" to guide a tape applicator on both the car frame portions and through the openings in the car frame portion. As such, the adhesive tape must be applied by hand. It is difficult and slow for operators to accurately apply the adhesive tape on the work surfaces in a reliable and repeatable manner, especially when the work surface has a complex geometry, openings, or when the work surface is inconvenient to access. Hence, there is a need for a simple, light weight, and cost-effective system that allows accurate application of adhesive tapes on various work surfaces.

The present solution relates to a system of for a tape guiding assembly for applying an adhesive tape line to a work surface. The tape guiding assembly includes one or more fastening members that are removably coupled to the work surface and a guiding board. The guiding board is coupled to the fastening members and provides a reference surface for applying the adhesive tape line. An adhesive tape dispenser that receives an adhesive tape spool can slide on the guiding board for applying the adhesive tape line on various work surfaces.

In an aspect of the present disclosure, a system for applying an adhesive tape line to a work surface is provided. The system includes a tape guiding assembly for removably coupling with the work surface. The tape guiding assembly includes at least one fastening member for removably coupling the tape guiding assembly to the work surface. The tape guiding assembly also includes a guiding board coupled with the at least one fastening member, wherein the guiding board includes a board sliding surface. The system also includes an adhesive tape dispenser having a dispenser sliding surface, the adhesive tape dispenser positionable on the board sliding surface and supported by the dispenser sliding surface for slidable translation on the board sliding surface when applying the adhesive tape line to the work surface.

In another aspect of the present disclosure, a method of applying an adhesive tape line to a car frame is provided. The method includes coupling, removably, at least one fastening member of a tape guiding assembly to the work surface. The method also includes coupling a guiding board of the tape guiding assembly with the at least one fastening member, wherein the guiding board includes a board sliding surface. The method further includes positioning an adhesive tape dispenser having a dispenser sliding surface on the board sliding surface. The method includes sliding the adhesive tape dispenser on the board sliding surface for applying the adhesive tape line to the work surface.

BRIEF DESCRIPTION OF THE DRAWINGS

Exemplary embodiments disclosed herein may be more completely understood in consideration of the following detailed description in connection with the following figures. The figures are not necessarily drawn to scale. Like numerals used in the figures refer to like components.

DETAILED DESCRIPTION

In the following description, reference is made to the accompanying figures that form a part thereof and in which various embodiments are shown by way of illustration. It is to be understood that other embodiments are contemplated and may be made without departing from the scope or spirit of the present disclosure. The following detailed description, therefore, is not to be taken in a limiting sense.

The present disclosure relates to a tape guiding assembly for applying an adhesive tape line to a work surface. The tape guiding assembly includes one or more fastening members and a guiding board. The tape guiding assembly provides a guiding surface for the adhesive tape line to slide along during application of the adhesive tape line. The tape guiding assembly simplifies an application process of the adhesive tape line on complex work surfaces and on work surfaces that are inconvenient to access. The tape guiding assembly can be easily coupled and removed from the work surface without requiring additional tools or fixtures. Moreover, the tape guiding assembly provides improved tape line accuracy and productivity in tape application processes. Additionally, one or more components of the tape guiding assembly are printed using a three-dimensional (3D) printing technique. Further, the tape guiding assembly is light in weight and cost-effective.

Figure 1A:
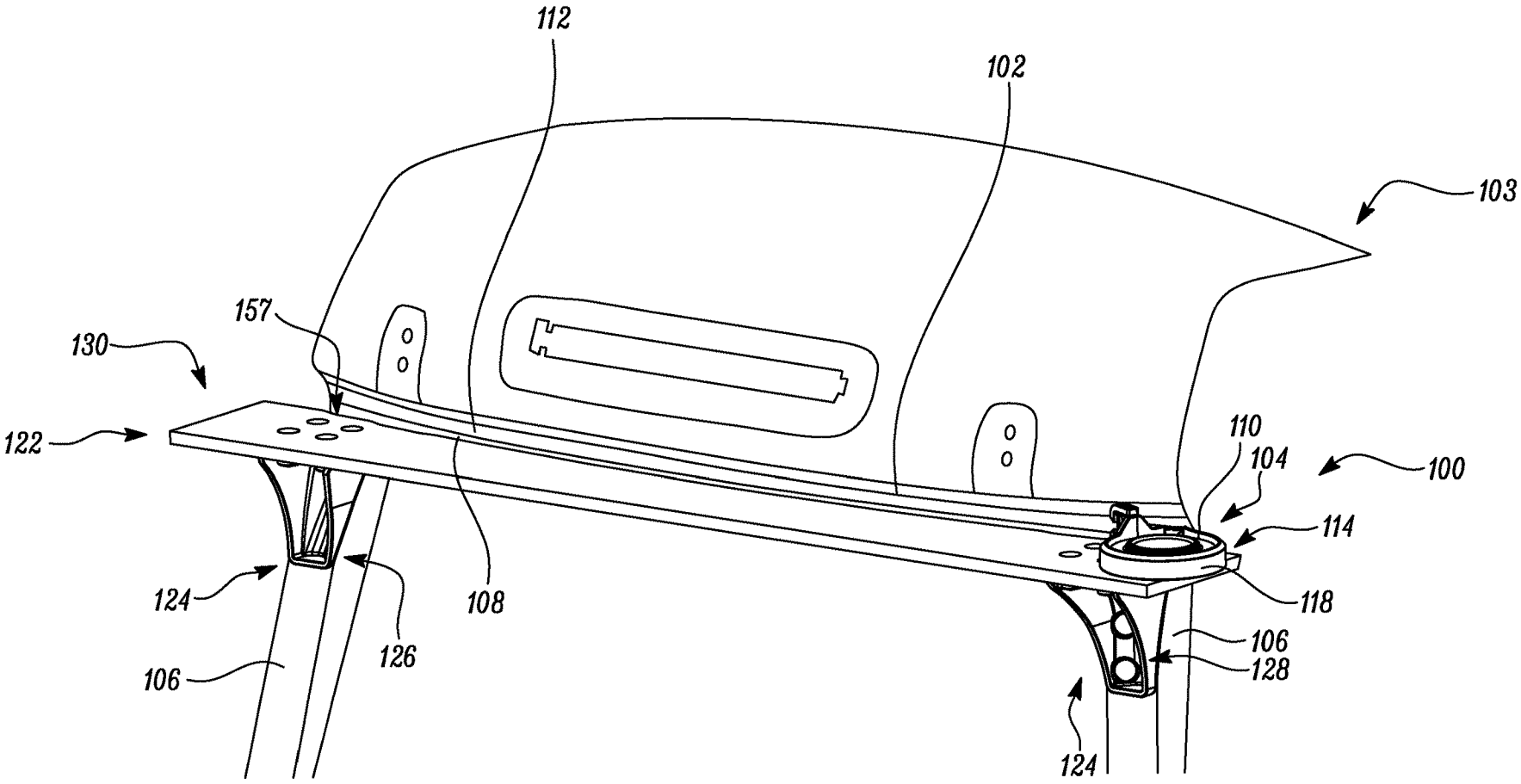
FIG. 1A is a perspective view of a system for applying an adhesive tape line to a work surface, according to an embodiment of the present disclosure.

FIG. 1A illustrates a system 100 for applying an adhesive tape line 102 to a work surface 104. In the illustrated example, the work surface 104 is a portion of a car frame 103. Alternatively. the work surface 104 may include any automotive part or a frame of any vehicle. The adhesive tape line 102 may be applied to the work surface 104 where a two-tone paint scheme is desired. In an example, the work surface 104 may embody a rear liftgate of a car, without any limitations. The work surface 104 includes a pair of first sections 106 and a second section 108. The adhesive tape line 102 is being applied on the second section 108. It should be noted that the work surface 104 illustrated herein is exemplary in nature and the work surface 104 may include any other shape and/or design. Further, the system 100 includes an adhesive tape spool 110 having the adhesive tape line 102 wound around a generally circular support core (not shown). The adhesive tape line 102 includes an adhesive side (not shown) that contacts the work surface 104 and a non-adhesive side 112 opposite to the adhesive side.

Figure 1B:
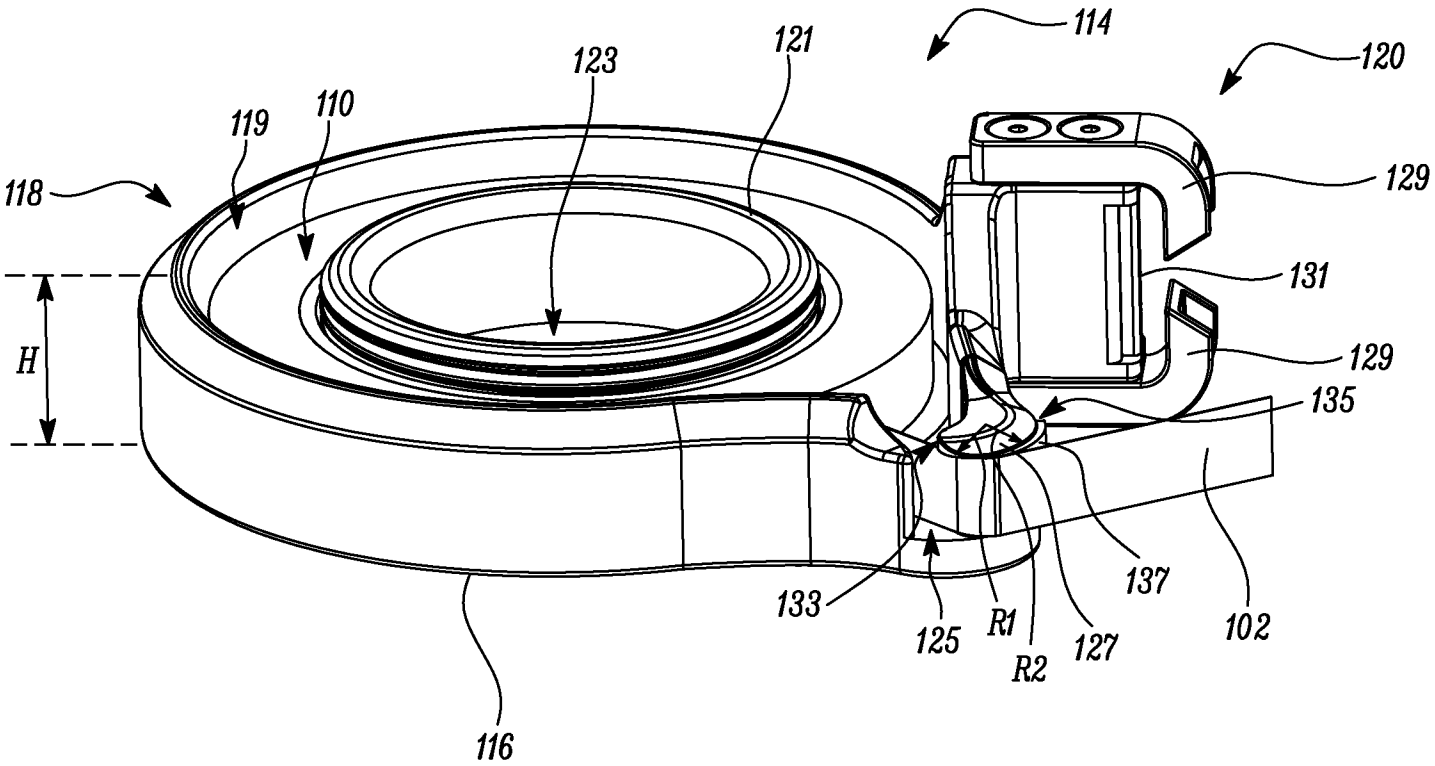
FIG. 1B is a perspective view of an adhesive tape dispenser associated with the system of FIG. 1A.
Figure 4:
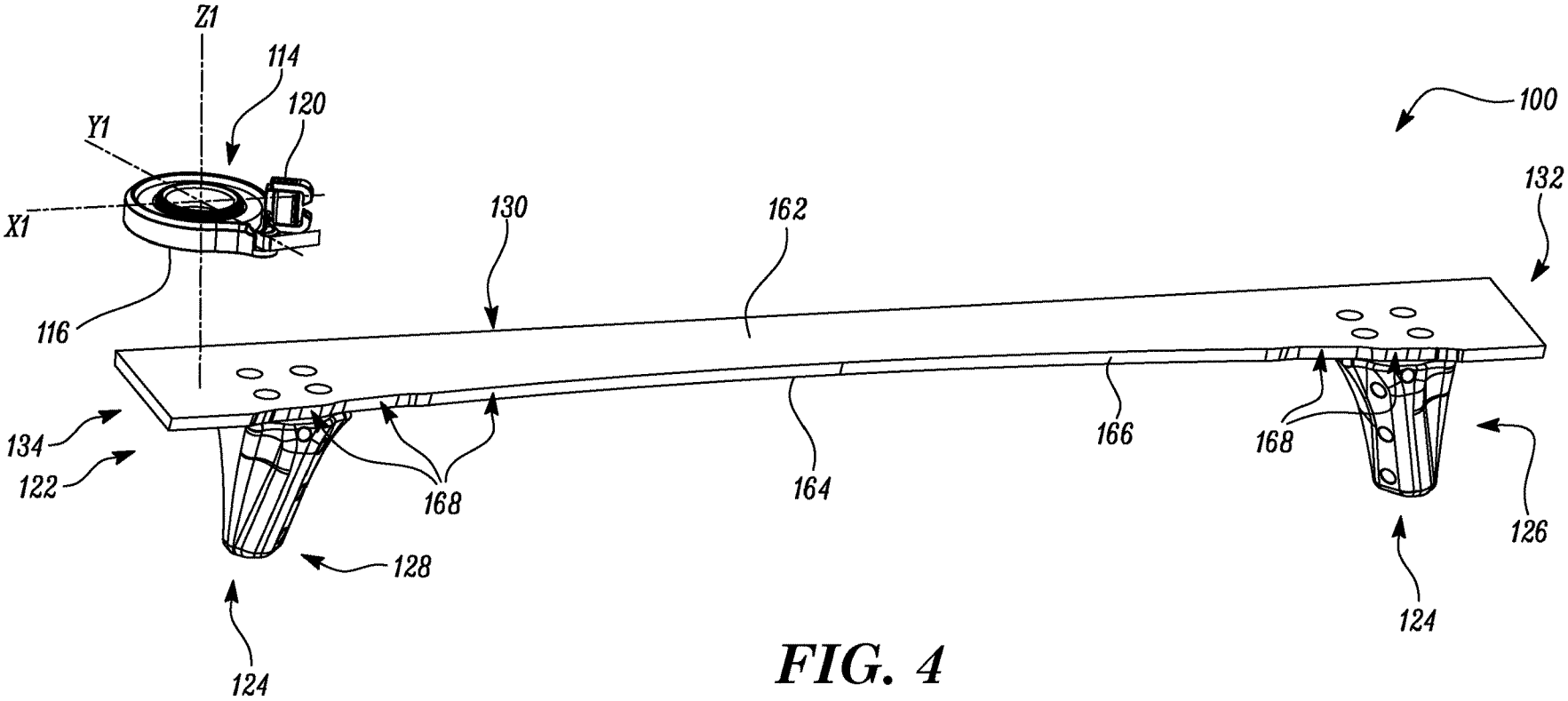
FIG. 4 is a rear perspective view of the tape guiding assembly of FIG. 2.

The system 100 includes an adhesive tape dispenser 114 having a dispenser sliding surface 116 (shown in FIG. 4). The dispenser sliding surface 116 includes a planar profile. As shown in FIG. 1B, the adhesive tape dispenser 114 defines a height "H". Further, the adhesive tape dispenser 114 includes a housing 118. The housing 118 defines the dispenser sliding surface 116. The housing 118 is embodied as a disc-shaped structure. The housing 118 defines a hollow space 119 for receiving the adhesive tape spool 110. More particularly, the housing 118 includes a hub portion 121, such that the adhesive tape spool 110 is received within the hollow space 119 and surrounds the hub portion 121. The hub portion 121 defines a central through-opening 123. The housing 118 also defines an exit opening 125 that guides the adhesive tape line 102 from the adhesive tape spool 110 towards the work surface 104 while applying the adhesive tape line 102 to the work surface 104. When the adhesive tape dispenser 114 slides along the work surface 104, the adhesive tape spool 118 may rotate with respect to the hub portion 121 for dispensing the adhesive tape line 102.

The housing 118 further defines an overhang portion 127 proximate the exit opening 125. A portion of the adhesive tape line 102 may slide over and contact the overhang portion 127 during the application of the adhesive tape line 102. The overhang portion 127 includes a curved shape. The overhang portion 127 defines a first section 133 and a second section 135. The first section 135 defines a first radius of curvature "R1" and the second section 137 defines a second radius of curvature "R2". A value of the first radius of curvature "R1" is smaller than a value of the second radius of curvature "R2". In an example, the first radius of curvature "R1" lies in a range from about 0.08 inches to about 0.2 inches and the second radius of curvature "R2" lies in a range from about 0.55 inches to about 0.7 inches. In an example, the first radius of curvature "R1" may be decided such that first section 133 can capture the adhesive tape line 102, eliminate drifting of the adhesive tape line 102, and bend the adhesive tape line 102 towards the work surface 104. In some examples, the second radius of curvature "R2" may be decided such that the second section 135 can be accommodated in compact spaces on the work surface 104 during tape application. It should be noted that the ranges for the first and second radius of curvatures "R1", "R2" given herein may vary based on factors, including but not limited to, a size of the adhesive tape dispenser 114, dimensions of the work surface 104, and the like.

As the adhesive tape line 102 is applied to the work surface 104, the overhang portion 127, and more specifically, the second section 135 of the overhang portion 127 may interact with the work surface 104 and force the adhesive tape line 102 towards the work surface 104. Further, the curved shape of the overhang portion 127 is specifically advantageous while applying the adhesive tape line 102 on curved surfaces and when the work surface 104 includes depressions or projections present thereon.

Further, the adhesive tape dispenser 114 includes a pressure pad 137 coupled at the second section 135 of the overhang portion 127. A shape of the pressure pad 137 corresponds to a shape of the second section 135. The pressure pad 137 includes a curved surface that contacts the non-adhesive side 112 of the adhesive tape line 102 when applying the adhesive tape line 102 to the work surface 104. More particularly, the pressure pad 137 contacts the adhesive tape line 102 and applies a force on the adhesive tape line 102 thereby helping to secure the adhesive tape line 102 to the work surface 104. The pressure pad 137 may also assist with smoothing out possible wrinkles and/or air bubbles depending on a width of the adhesive tape line 102. The pressure pad 137 may be embodied as a rectangular strip of material that is coupled proximate the second section 135. A material of the pressure pad 137 may include elastomeric materials, foam materials, bristle brushes, and the like, without any limitations. In an example, the pressure pad 137 may embody a double-sided foam tape, such as a urethane foam tape.

Further, an outside of the pressure pad 137 that contacts the adhesive tape line 102 is covered with an additional layer of an Ultra-High-Molecular-Weight (UHMW) material or any other low friction material that demonstrates anti-slip properties. In an example, the additional layer may include a UHMW polyethylene material. Such an additional layer presents a wear surface and may be easily replaceable. In some examples, the additional layer may be long enough to cover the pressure pad 137 and the first section 135 of the overhang portion 127 thereby providing an improved surface for the adhesive tape line 102 to slide on.

Further, the adhesive tape dispenser 114 includes a cutting arrangement 120 that allows cutting of the adhesive tape line 102. The cutting arrangement 120 is coupled to the housing 118. The cutting arrangement 120 is disposed proximate to the exit opening 125. The cutting arrangement 120 includes a pair of cutting guides 129 that are spaced apart from each other. Moreover, a cutting blade 131 extends between the pair of cutting guides 129. The pair of cutting guides 129 guard the cutting blade 131 therebetween and also guide the adhesive tape line 102. In an example, the cutting blade 131 may be angularly disposed. The cutting blade 131 is used to cut the adhesive tape line 102 at a desired length, as per application requirements. In an example, the cutting blade 131 includes a serrated blade design. In the illustrated example, the cutting blade 131 contacts the non-adhesive side 114 of the adhesive tape line 102. It should be noted that a design of the adhesive tape dispenser 114 described herein is exemplary in nature, and the adhesive tape dispenser 114 may include any other design or type, as per application requirements.

Figure 2:
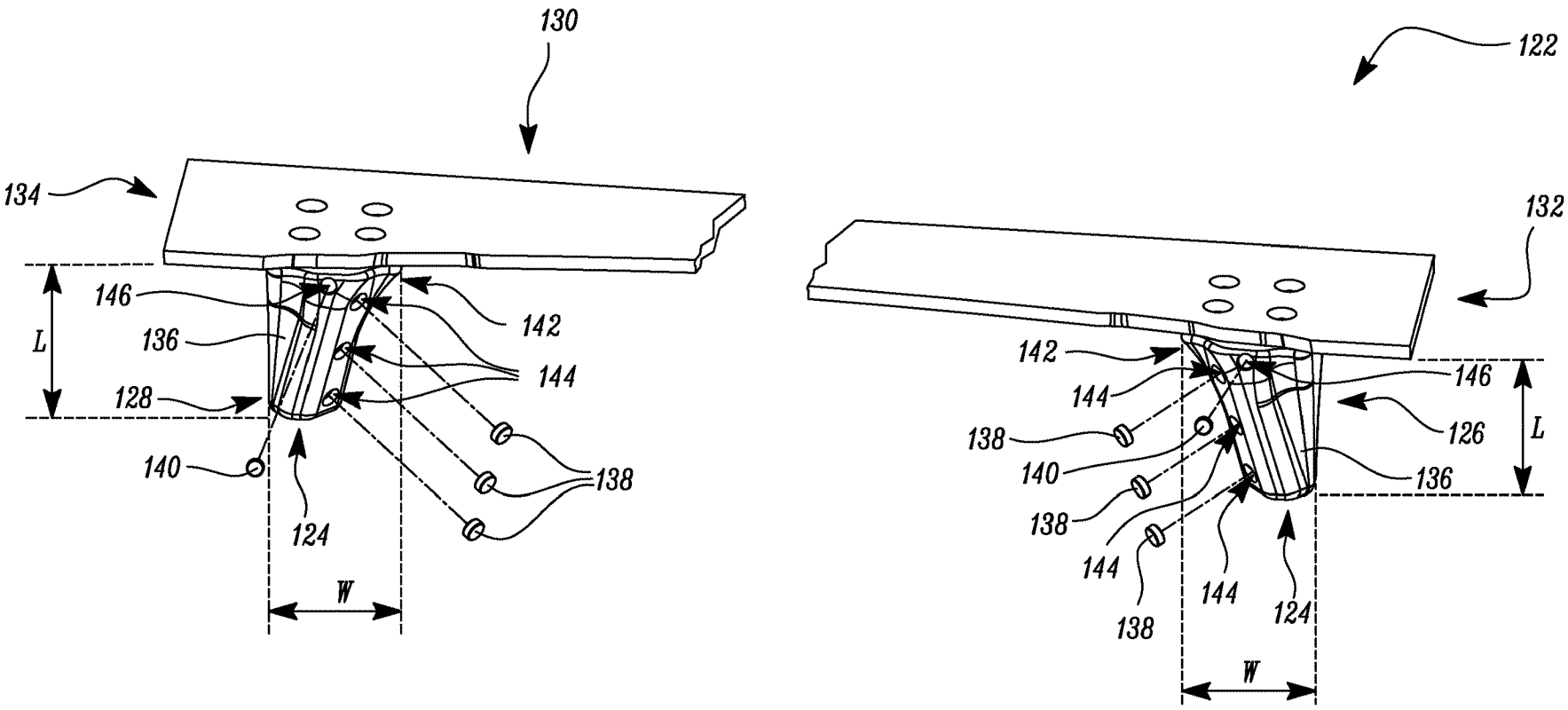
FIG. 2 is a front perspective view of a tape guiding assembly associated with the system of FIG. 1A.

Referring to FIG. 2, the system 100 also includes a tape guiding assembly 122 for removably coupling with the work surface 104 (see FIG. 1B). The tape guiding assembly 122 includes at least one fastening member 124 for removably coupling the tape guiding assembly 122 to the work surface 104. The one or more fastening members 124 are coupled to a guiding board 130. The fastening members 124 assist in locating the tape guiding assembly 122 at a desired location where the adhesive tape line 102 is to be applied. In various embodiments, the at least one fastening member 124 is selected from a group comprising magnets, pins and locating holes, clamps, threaded fastener, etc. In such embodiments, the fastening members 124 may be directly coupled to a side surface 166 (shown in FIG. 4) of the guiding board 130 for coupling the tape guiding assembly 122 to the work surface 104. The fastening members 124 may include other types of fastening members such as snap-fit locks, suction cups, and the like. It should be noted that the present disclosure is not limited to a type of the fastening member 124.

In the illustrated embodiment, the fastening members 124 include a pair of bracket members 126, 128. More particularly, the at least one fastening member 124 includes the first bracket member 126 removably coupled to the guiding board 130 proximate a first end 132 of the guiding board 130 and the second bracket member 128 removably coupled to the guiding board 130 proximate a second end 134 of the guiding board 130 that is distal from the first end 132. The first bracket member 126 may be hereinafter interchangeably referred to as the bracket member 126, the second bracket member 128 may be hereinafter interchangeably referred to as the bracket member 128, and the first and second bracket members 126, 128 may be collectively referred to as each bracket member 126, 128, without limiting the scope of the present disclosure.

The first and second bracket members 126, 128 are coupled to the corresponding first sections 106 of the work surface 104 for applying the adhesive tape line 102. In some embodiments, the fastening members 124 may include more than two bracket members or a single bracket member, without any limitations. Further, the first and second bracket members 126, 128 are symmetrical to each other. It should be noted that the first and second bracket members 126, 128 are similar in design.

Each bracket member 126, 128 defines a length "L", a width "W" that is defined proximate an upper end 142 of each bracket member 142, and a depth "D" that is defined proximate the upper end 142. It should be noted that the length "L", the width "W", and the depth "D" of each bracket member 126, 128 may vary based on dimensions of the first section 106 (see FIG. 1A) of the work surface 104 (see FIG. 1A). Further, each bracket member 126, 128 includes a first portion 136 that contacts the work surface 104 when the tape guiding assembly 122 is coupled to the work surface 104. In the illustrated example, the first portion 136 contacts with the first section 106 of the work surface 104. Further, a profile of the first portion 136 may match with an outer profile of the section 106 of the work surface 104 to which each bracket member 126, 128 is coupled. Additionally or alternatively, the length "L", the width "W", and the depth "D" of each bracket member 126, 128 may correspond to a length, a width, and a depth of the first section 106 to ensure that the bracket members 126, 128 fits at the exact location of the work surface 104. Similarities between the bracket members 126, 128 and the first section 106 in terms of shape and dimensions may ensure that the guiding board 130 is repeatably positioned in the same position on the car frame 103 such that the adhesive tape line 102 is accurately positioned on the car frame 103.

In some examples, other factors, such as a standard vertical distance between the bracket members 126, 128 and the adhesive tape line 102 may be considered to ensure that the guiding board 130 is repeatably positioned in the same position on the car frame 103. In such conditions, a thickness "T1" of the guiding board 130 and the height "H" of the adhesive tape dispenser 114 may be considered for deciding the standard vertical distance between the bracket members 126, 128 and the adhesive tape line 102. In other examples, any other technique that provides a reference for quick and repeatable coupling of the bracket members 126, 128 with the first section 106 is contemplated, without limiting the scope of the present disclosure.

The first portion 136 includes at least one of a straight profile and a curved profile. Depending upon the profile and/or shape of the work surface 104, the first portion 136 of each bracket member 126, 128 includes the straight profile, the curved profile, a combination thereof, or any other profile. In the illustrated example, the first portion 136 includes a generally curved profile as the outer profile of the first section 106 is curved.

Further, in the illustrated example, each bracket member 126, 128 is magnetically coupled to the work surface 104. Accordingly, each bracket member 126, 128 includes at least one magnet 138, 140 coupled to the first portion 136 of each bracket member 126, 128. Specifically, each bracket member 126, 128 includes three first magnets 138 and one second magnet 140. The first magnets 138 are disposed in a spaced apart manner along a length of each bracket member 126, 128 while the second magnet 140 is coupled proximate the upper end 142 of each bracket member 126, 128. Each of the first and second magnets 138, 140 are coupled to the first portion 136 of each bracket member 126, 128. The first magnets 138 are received within corresponding first grooves 144 in the first portion 136. Whereas the second magnet 140 is received within a second groove 146 in the first portion 136. It should be noted that a depth of the first grooves 144 and the second groove 146 is such that the respective first and second magnets 138, 140 are completely received therein. In the illustrated embodiment, the first magnets 138 and the second magnet 140 have circular shape. In other embodiments, the shape and size of the first magnets 138 and the second magnet 140 may vary, as per requirements. Further, a total number of the first and second magnets 138, 140 may also vary.

The first and second magnets 138, 140 provide an attractive force that assists in maintaining a rigid contact of the first bracket member 126 and the second bracket member 128 with the work surface 104. The first and second magnets 138, 140 ensure locking of each bracket member 126, 128 with the work surface 104 while applying the adhesive tape line 102 to the work surface 104. Moreover, the first and second magnets 138, 140 allow easy removal of the tape guiding assembly 122 when the tape guiding assembly 122 is not in use. The first and second magnets 138, 140 provide improved coupling and decoupling of the tape guiding assembly 122 with the work surface 104 in terms of repeatability, speed, and accuracy. In some examples, the tape guiding assembly 122 may omit the bracket members 126, 128 and the fastening members 124 may only include the first and second magnets 138, 140 that may be coupled to the guiding board 130. The first and second magnets 138, 140 may therefore facilitate removable coupling of the tape guiding assembly 122 with the work surface 104.

Figure 3:
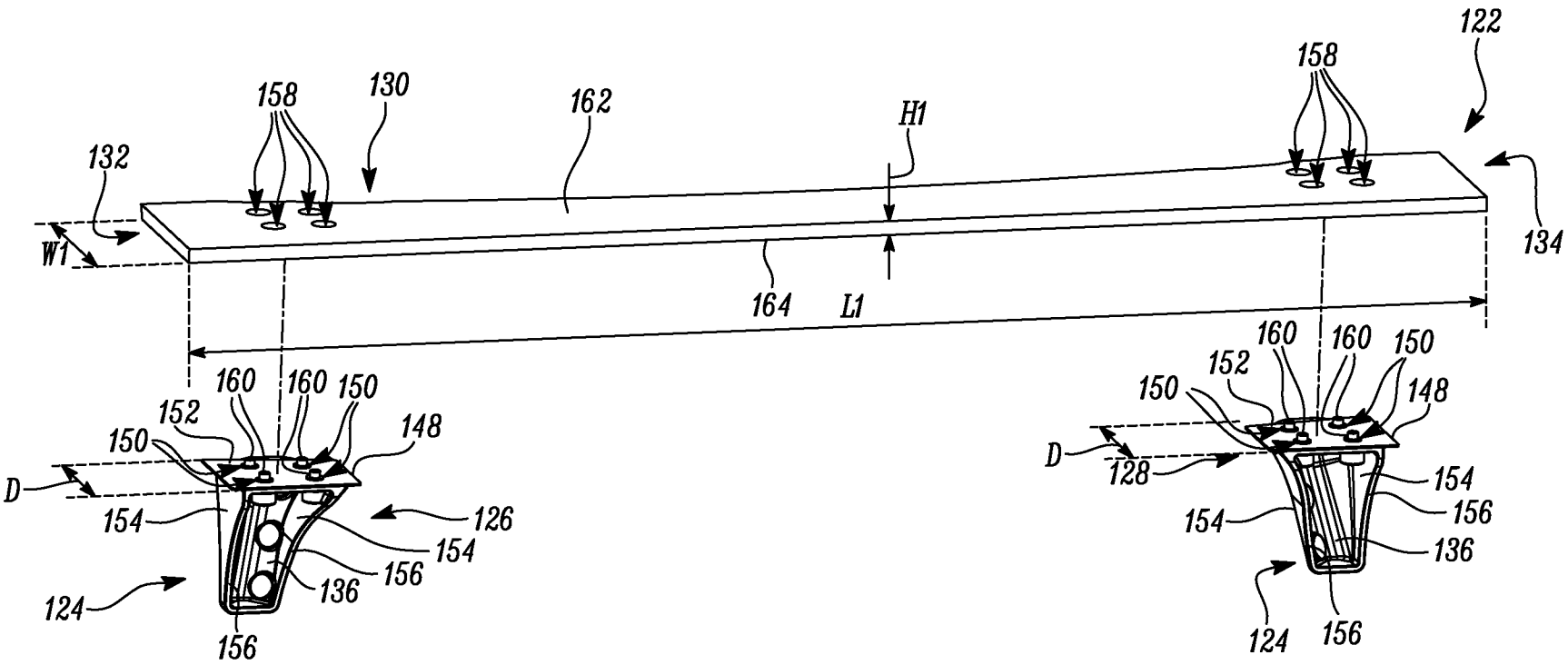
FIG. 3 is an exploded view of the tape guiding assembly of FIG. 2.

As shown in FIG. 3, each bracket member 126, 128 also includes a second portion 148 that contacts the guiding board 130 when the guiding board 130 is coupled to each bracket member 126, 128. The second portion 148 is substantially perpendicular to the first portion 136. The second portion 148 includes at least one first through-hole 150. In the illustrated example, the second portion 148 includes four first through-holes 150. The second portion 148 defines a planar top surface 152 on which the guiding board 130 rests. Further, each bracket member 126, 128 includes a pair of side portions 154 coupled to the first and second portions 136, 148. The side portions 154 are generally parallel to each other. Further, the side portions 154 include a curved profile or a straight profile depending on the outer profile of the first section 106. In the illustrated example, the side portions 154 have a curved profile. Each side portion 154 includes a curved surface 156.

Further, the tape guiding assembly 122 includes the guiding board 130 coupled with the at least one fastening member 124. The guiding board 130 is substantially rectangular in shape. The guiding board 130 may have any other shape such as a square shape, a semicircular shape, and the like. The guiding board 130 defines a length "L1", a width "W1", and the thickness "T1". It should be noted that the length "L1", the width "W1", and the thickness "T1" of the guiding board 130 may vary based on dimensions of the second section 108 (see FIG. 1A) of the work surface 104 (see FIG. 1A).

In the illustrated example, the guiding board 130 is removably coupled to the first and second bracket members 126, 128. The guiding board 130 defines the first end 132 such that each bracket member 126, 128 is coupled to the guiding board 130 proximate the first end 132. Further, the guiding board 130 defines the second end 134 such that the second bracket member 128 is coupled to the guiding board 130 proximate the second end 134. It should be noted that each bracket member 126, 128 is coupled to the guiding board 130 such that a clearance 157 (shown in FIG. 1A) is defined between the guiding board 130 and the work surface 104. As the guiding board 130 is spaced apart from the second section 108 of the work surface 104, any possibility of damage to the second section 108 due to interaction with the guiding board 130 may be eliminated.

Further, the guiding board 130 includes at least one second through-hole 158 that aligns with the at least one first through-hole 150 in the second portion 148 of each bracket member 126, 128 for receiving a mechanical fastener 160. The second through-holes 158 are disposed proximate each of the first end 132 and the second end 134 of the guiding board 130. In the illustrated example, the second through-holes 158 are embodied as clearance holes. In some examples, the second through-holes 158 may be envisioned as slots. While coupling the guiding board 130 with the bracket members 126, 128, the guiding board 130 may slide relative to the bracket members 126, 128 to adjust a positioning of the guiding board 130 relative to the work surface 104. The mechanical fasteners 160 may then be tightened to fix the guiding board 130 with the bracket members 126, 128. Thus, the second through-holes 158 that are embodied as clearance holes allow the guiding board 158 to be coupled with the bracket members 126, 128 at various distances relative to the guiding board 130. More particularly, this feature allows variation in the clearance 157 (see FIG. 1A) that is defined between the side surface 166 of the guiding board 130 and the work surface 104 and may also increase usability of the tape guiding assembly 122 as it can be used tape application on various work surfaces. The number of second through-holes 158 at each of the first and second ends 132, 134 is equal to a number of the first through-holes 150 in each bracket member 126, 128. In this example, the guiding board 130 includes four second through-holes 158 at each of the first and second ends 132, 134. Moreover, the tape guiding assembly 122 includes eight mechanical fasteners 178 for coupling the guiding board 130 with the first and second bracket members 126, 128. The mechanical fastener 160 are embodied as threaded fasteners herein. In an example, the mechanical fastener 178 may embody a ¼ inch bolt.

Further, the mechanical fastener 160 may include any one of a bolt, a screw, a pin, a rivet, and the like. Alternatively, any other fastening means such as magnets, suction cups, snap-fit locks, and the like may be used to couple the guiding board 130 with the first and second bracket members 126, 128. As the guiding board 130 needs to be disposed in a spaced apart manner from the second section 108, a position of the first and second through-holes 150, 158 in the guiding board 130 and the bracket members 126, 128, respectively, may be varied based on the clearance 157.

As shown in FIG. 4, the guiding board 130 includes a board sliding surface 162. The tape guiding assembly 122 is coupled to the second section 108 (see FIG. 1A) of the work surface 104 (see FIG. 1A) such that the board sliding surface 162 is located below a location on the work surface 104 on which the adhesive tape line 102 is to be applied. The adhesive tape dispenser 114 is positionable on the board sliding surface 162 and supported by the dispenser sliding surface 116 for slidable translation on the board sliding surface 162 when applying the adhesive tape line 102 to the work surface 104. Further, the dispenser sliding surface 116 contacts with the board sliding surface 162 when the adhesive tape dispenser 114 is positioned on the guiding board 130. The board sliding surface 162 includes a planar profile. The planar profile of the board sliding surface 162 allows a sliding motion of the adhesive tape dispenser 114 to assist in the application of the adhesive tape line 102. Further, the guiding board 130 allows movement of the adhesive tape dispenser 114 along a first axis "X1" extending along the guiding board 130, a second axis "Y1" perpendicular to the first axis "X1", and yaw about a third axis "Z1" that is perpendicular to the board sliding surface 162. Moreover, the adhesive tape dispenser 114 is restricted to move along the third axis "Z1", roll about the second axis "Y1", and pitch about the first axis "X1". It should be appreciated that, in some examples, the system 100 may omit the adhesive tape dispenser 114 and the adhesive tape spool 110 (see FIG. 1A) can directly slide on the guiding board 130 for applying the adhesive tape line 102.

The guiding board 130 also includes a non-sliding surface 164 opposite to the board sliding surface 162. The non-sliding surface 164 is in contact with the second portion 148 (see FIG. 3) of each bracket member 126, 128 when the guiding board 130 is coupled to each bracket member 126, 128. The non-sliding surface 164 has a profile which matches with a profile of the second portion 148 of each bracket member 126, 128. In the illustrated example, the non-sliding surface 164 includes a planar profile that contacts with the top surface 152 (see FIG. 3) of the second portion 148.

The guiding board 130 further includes the side surface 166 that is proximate the work surface 104 when the tape guiding assembly 122 is coupled to the work surface 104. Moreover, the clearance 157 is defined between the side surface 166 and the work surface 104 when the tape guiding assembly 122 is coupled to the work surface 104. The side surface 166 is disposed proximate the second section 108 of the work surface 104. Further, a profile of the side surface 166 matches with an outer profile of the section 108 of the work surface 104 that is proximate the guiding board 130. The side surface 166 includes at least one of a straight profile, a curved profile, and a stepped design to accommodate the section 108 of the work surface 104 that is proximate the guiding board 130. In the illustrated example, the side surface 166 includes a stepped design that is characterized by stepped portions 168. The stepped design of the side surface 166 allow accommodation of the second section 108 of the work surface 104 proximate the guiding board 130.

During coupling of the guiding board 130 with the bracket members 126, 128, the guiding board 130 is positioned such that the non-sliding surface 164 contacts the second portion 138 of each bracket member 126, 128. It should be noted that the guiding board 130 is positioned such that each second through-hole 158 (see FIG. 3) aligns with a corresponding first through-hole 150 (see FIG. 3). Moreover, the stepped portions 168 align with corresponding stepped portions (not shown) on the second section 108. These features may ensure accurate and repeatable positioning of the guiding board 130 relative to the bracket members 126, 128 and the second section 108, which may in turn increase an accuracy of the tape application process. Further, as the second through-holes 158 are embodied as clearance holes herein, the clearance 157 can be easily varied as required based on adjusting the position of the guiding board 130 relative to the bracket members 126, 128. Once the guiding board 130 is positioned, the mechanical fasteners 178 are aligned and received within the corresponding first and second through-holes 150, 158 for coupling the guiding board 130 with each bracket member 126, 128.

For applying the adhesive tape line 102, a portion of the adhesive tape line 102 is contacted with the second section 108. Further, the operator may slide the adhesive tape dispenser 114 from the first end 132 towards the second end 134, or vice versa. Moreover, the cutting arrangement 120 may be used to cut the adhesive tape line 102 at a desired location. It should be noted that dimensions of the guiding board 130, the first bracket member 126, and the second bracket member 128 may be varied based on a size of the work surface 104. It should be noted that the guiding board 130, the first bracket member 126, and the second bracket member 128 may include different shapes and/or designs based on the work surface 104 to which the tape guiding assembly 122 is coupled.

Further, at least one of the guiding board 130 and each bracket member 126, 128 is manufactured by a 3D printing process. Such 3D printed components may make the tape guiding assembly 122 light in weight. Moreover, the guiding board 130, the first bracket member 126, and the second bracket member 128 including complex designs may be easily manufactured using the 3D printing process. It should be noted that other manufacturing techniques may be utilized to manufacture the above mentioned components, without limiting the scope of the present disclosure. In some examples, composite materials may be used for manufacturing the guiding board 130, the first bracket member 126, and the second bracket member 128. In an example, the guiding board 130 may be made of a honeycomb material. The honeycomb material may include a paper and an outer sheet made up of a Nomex® material. Such a material combination makes the guiding board 130 lighter and stiffer. Further, the bracket members 126, 128 may be made up of plastic or foam material as they are light in weight, cheaper, and easy to procure. In other examples, the guiding board 130 and the bracket members 126, 128 may also be made of a light-weight metal or alloy. It should be noted that the scope of this disclosure is not limited to the material of the guiding board 130, the first bracket member 126, and the second bracket member 128.

Figure 5:
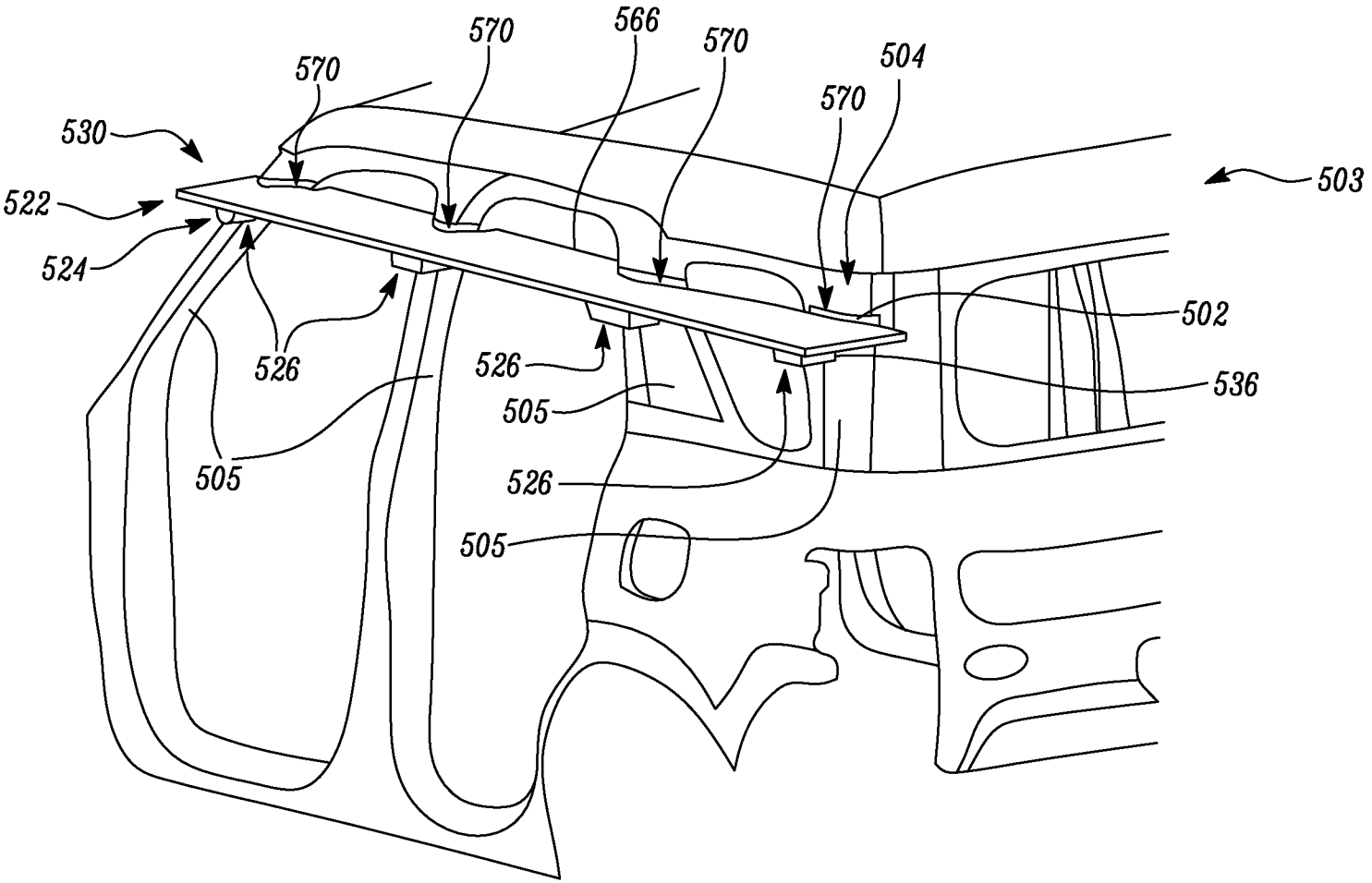
FIG. 5 illustrates a tape guiding assembly for applying an adhesive tape line to a work surface, according to another embodiment of the present disclosure.

FIG. 5 illustrates another design of a tape guiding assembly 522 coupled to a work surface 504 for applying an adhesive tape line 502. The work surface 504 is embodied as a portion of a car frame 503. The work surface 504 includes four sections 505. The sections 505 are embodied as pillars of the car frame 503. Further, the tape guiding assembly 522 includes one or more fastening members 524. The fastening members 524 are embodied as bracket members 526 herein. In this embodiment, the tape guiding assembly 522 includes four bracket members 526. A design of the four bracket members 526 are different from a design of the first and second bracket members 526 of the tape guiding assembly 122 explained in relation to FIGS. 1 to 4. In other examples, the design of the four bracket members 526 may be similar to the design of the first and second bracket members 126, 128. Further, details related to coupling of the bracket members 526 with a guiding board 530 and the work surface 504 is similar to the details related to the coupling of the first and second bracket members 126, 128 with the guiding board 130 and the work surface 104 described in association with the tape guiding assembly 122 of FIGS. 1 to 4.

As illustrated, the bracket members 526 are embodied as rectangular blocks coupled to the guiding board 530 and the work surface 504. The bracket members 526 are coupled with the corresponding sections 505 of the work surface 504. More particularly, the bracket members 526 define a first portion 536 that is coupled with the work surface 504. A profile of the first portion 536 matches with a profile of the work surface 504. The bracket members 526 may be coupled to the section 505 using magnets, pins and locating holes, clamps, threaded fastener, etc. Further, the bracket members 526 may be coupled to the guiding board 530 using mechanical fasteners, such as a bolt, a screw, a pin, a rivet, and the like. Alternatively, the bracket members 526 may be coupled to the guiding board 530 using suction devices, snap-fit locks, and the like.

The tape guiding assembly 522 also includes the guiding board 530 similar to the guiding board 130 of the tape guiding assembly 122 explained in relation to FIGS. 3 and 4. Further, the guiding board 530 includes a side surface 566. A profile of the side surface 566 matches with the profile of the work surface 504. The side surface 566 includes at least one opening 570 to accommodate the section 505 of the work surface 504 that is proximate the guiding board 530. In the illustrated example, the side surface 566 includes four openings 570. During coupling of the guiding board 530 with the bracket members 526, 528, the guiding board 530 is positioned such that the openings 570 align with and receive the sections 505. This feature ensures accurate positioning of the guiding board 530 relative to the work surface 504, which may in turn increase an accuracy of the tape application process.

Figure 6:
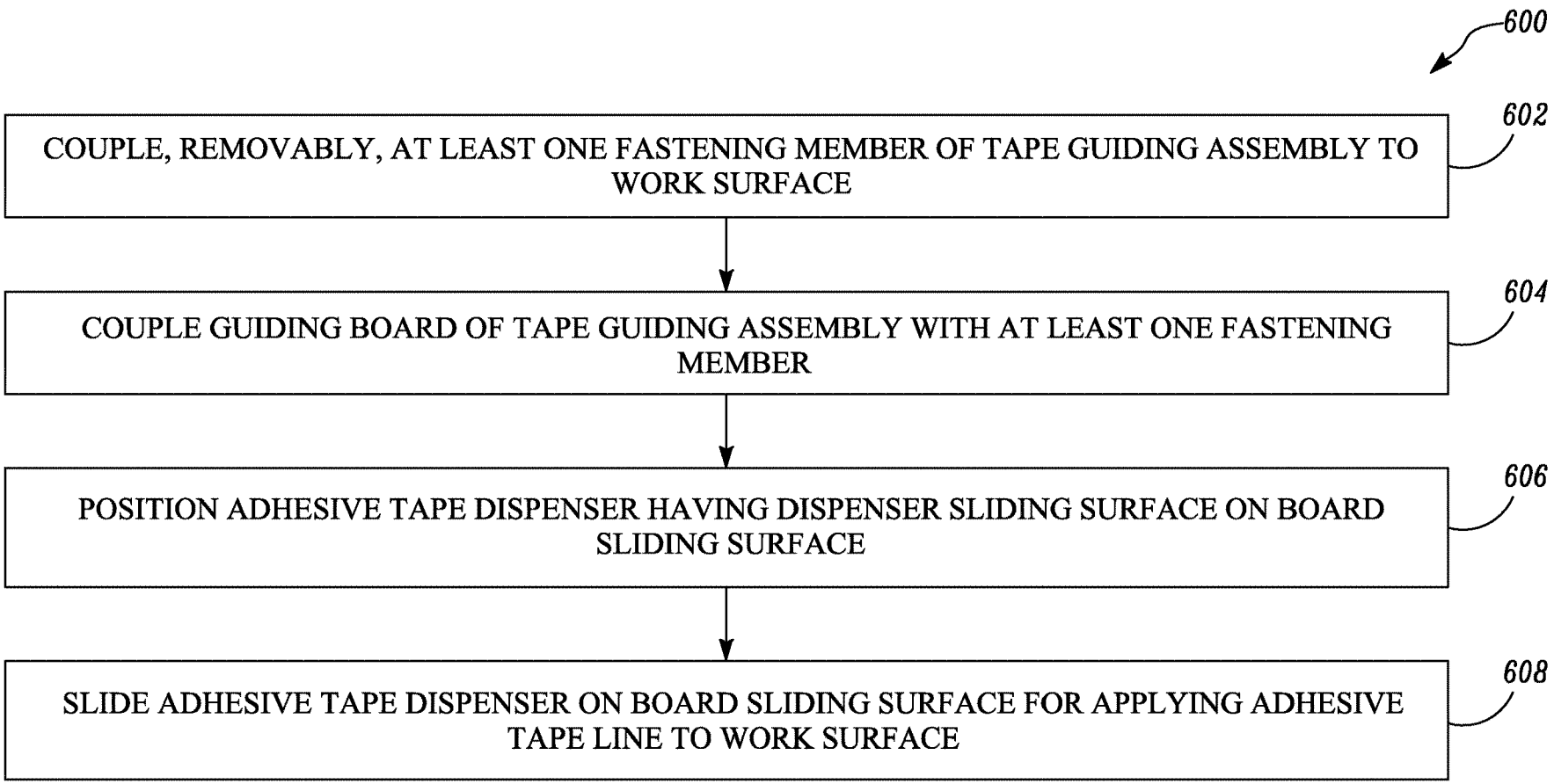
FIG. 6 is a flowchart for a method of applying the adhesive tape line on a car frame.

Referring to FIG. 6, a flowchart for a method 600 of applying the adhesive tape line 102, 502 on the car frame 103, 503 is illustrated. The method 600 will now be explained in relation to the application of the adhesive tape line 102 using the tape guiding assembly 122 of FIGS. 1 to 4. However, it should be noted that the method 600 is equally applicable to the application of the adhesive tape line 502 using the tape guiding assembly 522 of FIG. 5. At step 602, the at least one fastening member 124 of the tape guiding assembly 122 is removably coupled to the work surface 104.

The tape guiding assembly 122 is coupled to the work surface 104 using the at least one fastening member 124 selected from the group comprising magnets, pins and locating holes, clamps, threaded fastener, etc. In this example, the first bracket member 126 is removably coupled to the guiding board 130 proximate the first end 132 of the guiding board 130 and the second bracket member 128 is removably coupled to the guiding board 130 proximate the second end 134 of the guiding board 130 that is distal from the first end 132. Further, the first portion 136 of each bracket member 126, 128 is coupled with the section 106 of the work surface 104, wherein the profile of the first portion 136 matches with the outer profile of the section 106 of the work surface 104. Moreover, each bracket member 126, 128 is magnetically coupled to the work surface 104. More particularly, the at least one magnet 138, 140 is coupled to the first portion 136 of each bracket member 126, 128.

At step 604, the guiding board 130 of the tape guiding assembly 122 is coupled with the at least one fastening member 124, wherein the guiding board 130 includes the board sliding surface 162. The coupling of the guiding board 130 to each bracket member 126, 128 includes contacting the non-sliding surface 164 of the guiding board 130 with the second portion 148 of each bracket member 126, 128, wherein the non-sliding surface 164 is opposite to the board sliding surface 162. Further, the at least one first through-hole 150 in the second portion 148 of each bracket member 126, 128 is aligned with at least one second through-hole 158 in the guiding board 130 for receiving the mechanical fastener 160. The second portion 148 is perpendicular to the first portion 136. Each bracket member 126, 128 is coupled to the guiding board 130 such that the clearance 157 is defined between the guiding board 130 and the work surface 104. Moreover, the side surface 166 of the guiding board 130 is disposed proximate the section 108 of the work surface 104. The profile of the side surface 166 matches with the outer profile of the section 108 of the work surface 104 that is proximate the guiding board 130. Furthermore, the side surface 166 of the guiding board 130 is disposed proximate the section 108 of the work surface 104, such that the clearance 157 is defined between the side surface 166 and the work surface 104. At step 606, the adhesive tape dispenser 114 having the dispenser sliding surface 116 is positioned on the board sliding surface 162. At step 608, the adhesive tape dispenser 114 slides on the board sliding surface 162 for applying the adhesive tape line 102 to the work surface 104.

The tape guiding assembly 122 provides a reliable guiding reference for the adhesive tape dispenser 114 to slide along a desired path during the application of the adhesive tape line 102. Further, due to the coupling of the fastening members 124 to the work surface 104, the adhesive tape dispenser 114 can only move along the first axis "X1" and the second axis "Y1", and yaw about the third axis "Z1", whereas the adhesive tape dispenser 114 is restricted to move along the third axis "Z1", roll about the second axis "Y1", and pitch about the first axis "X1". Thus, the tape guiding assembly 122 provides a high degree of accuracy during the application of the adhesive tape line 102 on the work surface 104 since the tape guiding assembly 122 restricts the degree of freedom of the adhesive tape dispenser 114.

Further, a design of the side surface 166 of the guiding board 130 and the first portion 136 of the bracket members 126, 128 may be varied to match the profile of the work surface 104 to accommodate work surfaces 104 having complex designs. Thus, the tape guiding assembly 122 may be used as a reference for work surfaces 104 having different shapes. Further, the tape guiding assembly 122 described herein is robust and easy to manufacture. Moreover, the tape guiding assembly 122 reduces an amount of time required for application of the adhesive tape line 102. The tape guiding assembly 122 may also increase productivity at a job site as the time required for applying the adhesive tape line 102 reduces.

It should be further noted that the system 100 disclosed herein can be used in an automated setting, as per requirements. For example, the tape guiding assembly 122 can be coupled and/or held into position through robotic positioning. In another example, the adhesive tape dispenser 114 can be manually moved along the guiding board 130 or a robotic arm, or other such automated devices, may be used to move the adhesive tape dispenser 114 along the guiding board 130, without limiting the scope of the present disclosure.

What is claimed is:

1. A system for applying an adhesive tape line to a work surface, the system comprising:

a tape guiding assembly for removably coupling with the work surface, the tape guiding assembly including:

at least one fastening member for removably coupling the tape guiding assembly to the work surface, wherein the at least one fastening member includes a first bracket member removably coupled to the guiding board proximate a first end of the guiding board and a second bracket member removably coupled to the guiding board proximate a second end of the guiding board that is distal from the first end; and a guiding board coupled with the at least one fastening member, wherein the guiding board includes a board sliding surface; and an adhesive tape dispenser having a dispenser sliding surface, the adhesive tape dispenser positionable on the board sliding surface and supported by the dispenser sliding surface for slidable translation on the board sliding surface when applying the adhesive tape line to the work surface.

2. The system of claim 1, wherein the board sliding surface includes a planar profile.

3. The system of claim 1, wherein the guiding board is substantially rectangular in shape.

4. The system of claim 1, wherein each of the first bracket member and the second bracket member includes:

a first portion that contacts the work surface when the tape guiding assembly is coupled to the work surface;

a second portion that contacts the guiding board when the guiding board is coupled to the first bracket member and the second bracket member, the second portion including at least one first through-hole; and a pair of side portions coupled to the first and second portions.

5. The system of claim 4, wherein a profile of the first portion matches with an outer profile of a section of the work surface to which the first bracket member and the second bracket member are coupled.

6. The system of claim 4, wherein each side portion includes a curved surface.

7. The system of claim 4, wherein each of the first bracket member and the second bracket member includes at least one magnet coupled to the first portion.

8. The system of claim 4, wherein the guiding board includes at least one second through-hole that aligns with the at least one first through-hole in the second portion of each of the first bracket member and the second bracket member for receiving a mechanical fastener.

9. The system of claim 4, wherein the guiding board includes a non-sliding surface opposite to the board sliding surface, and wherein the non-sliding surface is in contact with the second portion of each of the first bracket member and the second bracket member when the guiding board is coupled to the first bracket member and the second bracket member.

10. The system of claim 1, wherein the guiding board includes a side surface that is proximate the work surface when the tape guiding assembly is coupled to the work surface, and wherein a profile of the side surface matches with an outer profile of a section of the work surface that is proximate the guiding board.

11. The system of claim 10, wherein the side surface includes at least one opening to accommodate the section of the work surface that is proximate the guiding board.

12. The system of claim 1, wherein at least one of the guiding board, the first bracket member, and the second bracket member is manufactured by a three-dimensional printing process.

13. A method of applying an adhesive tape line to a car frame using the system of claim 1, the method comprising:

coupling, removably, the at least one fastening member of the tape guiding assembly to a work surface, wherein the work surface is a portion of the car frame;

coupling the guiding board of the tape guiding assembly with the at least one fastening member, wherein the guiding board includes the board sliding surface;

positioning the adhesive tape dispenser having the dispenser sliding surface on the board sliding surface; and sliding the adhesive tape dispenser on the board sliding surface for applying the adhesive tape line to the work surface.

14. The method of claim 13 further comprising magnetically coupling the first bracket member and the second bracket member to the work surface.

15. The method of claim 13 further comprising coupling a first portion of each of the first bracket member and the second bracket member with a section of the work surface, wherein a profile of the first portion matches with an outer profile of the section of the work surface.

16. The method of claim 15 further comprising aligning at least one first through-hole in a second portion of each of the first bracket member and the second bracket member with at least one second through-hole in the guiding board for receiving a mechanical fastener, wherein the second portion is perpendicular to the first portion.

17. The method of claim 16, wherein the step of coupling the guiding board to each of the first bracket member and the second bracket member includes contacting a non-sliding surface of the guiding board with the second portion of each of the first bracket member and the second bracket member, wherein the non-sliding surface is opposite to the board sliding surface.

18. The method of claim 13, wherein the step of coupling the guiding board with the at least one fastening member includes disposing a side surface of the guiding board proximate a section of the work surface, and wherein a profile of the side surface matches with an outer profile of the section of the work surface that is proximate the guiding board.

* * * * *